US006231164B1

(12) United States Patent
Shibata et al.

(10) Patent No.: US 6,231,164 B1
(45) Date of Patent: May 15, 2001

(54) APPARATUS AND METHOD FOR DIRECT PRINTING USING FIRST AND SECOND ELECTRODES TO DEPOSIT CHARGED PARTICLES

(75) Inventors: Yoshifumi Shibata, Toyokawa; Toshio Yamaki, Takatsuki; Hirokatsu Shimada, Machida; Koji Uno, Kobe; Hiroshi Hiraguchi, Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/196,678

(22) Filed: Nov. 20, 1998

(30) Foreign Application Priority Data

Nov. 25, 1997 (JP) ..... 9-322949

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 5,477,250 12/1995 Larson ..... 347/55
5,767,879 * 6/1998 Tsukamoto et al. ..... 347/55
6,109,730 * 8/2000 Nilsson et al. ..... 347/55

FOREIGN PATENT DOCUMENTS 0 710 897 A1 5/1996 (EP) .
0 752 317 A1 1/1997 (EP) .
0 753 412 A1 1/1997 (EP) .
0 769 384 A2 4/1997 (EP) .

* cited by examiner

*Primary Examiner*—John Barlow
*Assistant Examiner*—R. Gordon
(74) *Attorney, Agent, or Firm*—Morrison & Foerster LLP

(57) ABSTRACT

The printing head 50 includes an insulative member 52 in which pluralities of apertures 56 are formed. Doughnut-like first and second electrodes 68 and 70 are disposed around the aperture 56. Pulse voltages V1(P) and V2(P) both having a certain polarity opposite to that of the toner particles are applied to the first and second electrodes 68 and 70, energizing the toner particles 38 to afford propelling thereof. Subsequently, a voltage V2(B) having the same polarity as the charged toner particles 38 is applied to the second electrode 70, forcing radially inwardly to converge the propelling toner particles 38 in the aperture 56. This ensures that a dot and an image both having clear contour can be formed on the sheet 8.

18 Claims, 9 Drawing Sheets

Fig.5
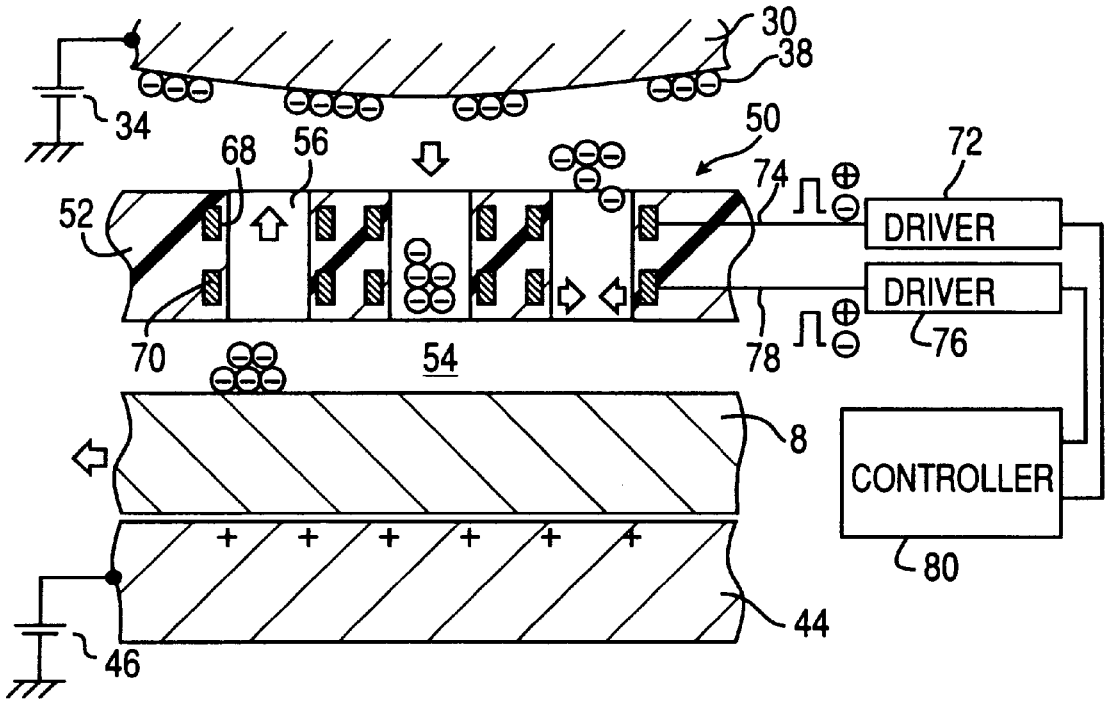
Fig.6A
1ST IMAGE SIGNAL
Fig.6B
2ND IMAGE SIGNAL
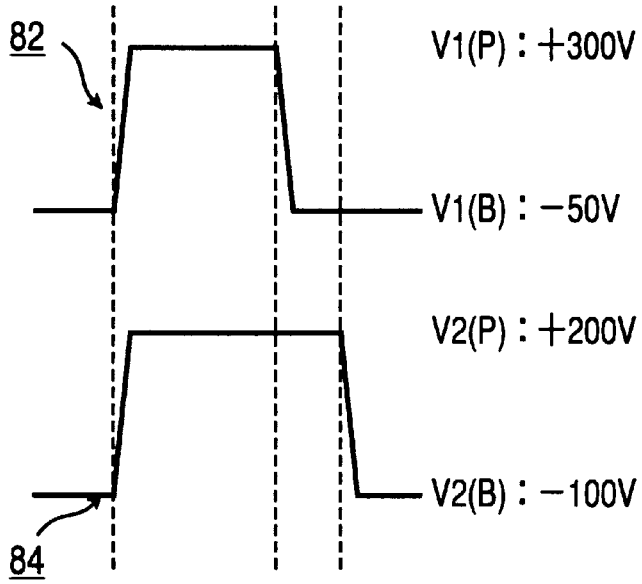

82
1ST IMAGE SIGNAL
V1(P) : +300V
V1(B) : −50V

2ND IMAGE SIGNAL
V2(P) : +200V
V2(B) : −100V
84

82
V1(P)
V1(B)
V2(P)
V2(B)
84

1ST IMAGE SIGNAL

2ND IMAGE SIGNAL

1ST IMAGE SIGNAL

2ND IMAGE SIGNAL

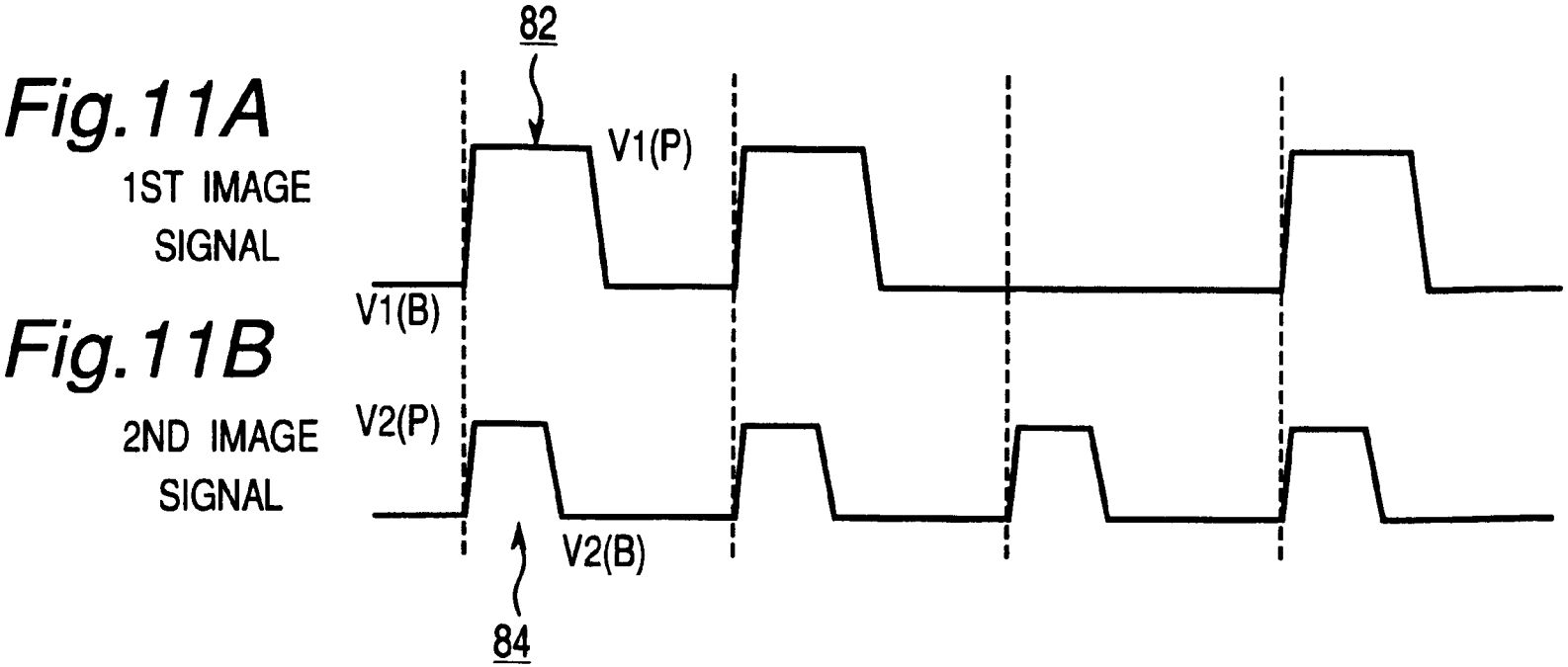
Fig.11A 1ST IMAGE SIGNAL
Fig.11B 2ND IMAGE SIGNAL

APPARATUS AND METHOD FOR DIRECT PRINTING USING FIRST AND SECOND ELECTRODES TO DEPOSIT CHARGED PARTICLES

FIELD OF THE INVENTION

The present invention relates to a direct printing apparatus and also to a printing head for use in the direct printing apparatus. Further, the invention relates to a direct printing method for suitably employed in such direct printing apparatus and printing head.

BACKGROUND OF THE INVENTION

U.S. Pat. No. 5,477,250 issued on Dec. 19, 1995 discloses a direct printing apparatus. The direct printing apparatus includes a rotatable cylinder or toner carrier retaining charged toner particles on its outer periphery, and a backing electrode spaced apart from the toner carrier. The backing electrode is electrically connected to a power source, thereby forming an electric field for attracting the charged toner particles on the toner carrier toward the backing electrode. Interposed between the toner carrier and the backing electrode is an insulating plate having a plurality of apertures through which the toner particles can pass. The insulating plate bears signal electrodes on one surface facing the backing electrode and base electrodes on the other surface facing the toner carrier, and each pair of signal and base electrodes surround the aperture.

In operation, if negatively charged toner particles are used, a positive voltage is charged to the backing electrode. In this instance, when a negative voltage is applied to the base electrode while a positive voltage is applied to the signal electrode, an electric field is formed from the signal electrode to the base electrode, which affords propelling of the negatively charged toner particles through the aperture onto a sheet substrate such as plain paper which is moving past between the insulating plate and the backing electrode. Then, with keeping the voltage applied to the base electrode unchanged, the voltage applied to the signal electrode is changed so that an electric field is formed from the base electrode to the signal electrode, thereby inhibiting an additional propelling of the toner particles.

As described, according to the prior art direct printing apparatus, the propelling of the toner particles is controlled by changing the voltage applied to the signal electrode and thereby reversing the direction of the electric field, in order to form an image of toner particles on the sheet substrate transported between the insulating plate and the backing electrode.

The direct printing apparatus, however, has a drawback that the toner particles tend to diverge in their propelling. Therefore, each resultant dot formed by the toner particles on the sheet substrate is relatively large in size than expected, reducing the density and clearness thereof.

SUMMARY OF THE INVENTION

The primary object of the invention is to provide a direct printing apparatus, a direct printing head, and a direct printing method capable of forming a dot having a high density and clear contour on the sheet substrate.

To this end, a direct printing apparatus of the invention comprises a bearing member for bearing charged printing particles thereon, a backing electrode opposed to the bearing member, and a power supply for generating an electric field that attracts the charged developer particles on the bearing member toward the backing electrode. The printing apparatus further comprises a printing head disposed between the bearing member and the backing electrode to form a passage with the backing electrode through which passage the sheet substrate can pass. The printing head includes an insulative sheet member having a plurality of apertures through which the printing particles can propel and plurality pairs of first and second electrodes. Each pair of the first and second electrodes surrounds the aperture. A first driver applies the first electrodes with a first signal in response to an image signal. The first signal has a voltage for energizing the printing particle on the bearing member to propel the same into associated aperture toward the backing electrode. Further, a second driver applies the second electrode with a second signal in response to the image signal. The second signal has a first voltage for attracting the printing particles on the bearing member to propel the same into associated apertures toward the backing electrode and a second voltage applied to the second electrode subsequent to the first voltage for forcing radially inwardly to converge the printing particles propelling in the aperture.

Preferably, the first and second electrodes are in the form of doughnut so that they surround the aperture. Advantageously, the second voltage applied to the second electrode has a different polarity from that of the printing particle.

According to a direct printing method for propelling charged printing particles through an aperture formed in an insulative member and thereby depositing the charged printing particles onto a substrate, first and second voltages having a polarity opposite to that of the charged printing particles are applied to first and second electrodes, respectively, mounted adjacent the aperture for energizing to propel the printing particles. Then, a third voltage which is different from the first voltage is applied to the first electrode for de-energizing the printing particles on the bearing member. Also, a fourth voltage which is different from the second voltage is applied to the second electrode for forcing radially inwardly to converge the printing particles propelling in the aperture.

Preferably, the first electrode is arranged on one side adjacent said bearing member (i.e., on an upstream side with respect to a propelling direction of the printing material) and the second electrode is arranged on the other side adjacent the backing electrode (i.e., on a downstream side with respect to the propelling direction).

Further, the second electrodes in the printing head may be electrically connected with each other.

According to the invention, by applying respective voltages to the first and second electrodes, the printing particles on the portion of the bearing member opposing the first and second electrodes are energized and propelled into the aperture. Subsequently, the voltage to be applied to the second electrode is changed so that the printing particles propelling in the aperture are forced radially, inwardly to be converged, and then deposited on the sheet substrate.

As described, the printing materials on the bearing member are energized intensely by the first and second electrodes and therefore a greater number of printing particles are propelled into the aperture, which ensures that the high density dot is formed on the sheet substrate.

In addition, the propelled printing particles are converged in the aperture by the voltage applied to the second electrode and therefore not only the dot but also the resultant image formed by dots has a clear contour and high density.

BRIEF DESCRIPTION OF THE DRAWINGS

The present invention will be further described with reference to the accompanying drawings wherein like reference numerals refer to like parts in the several views, and wherein:

FIG. 5 is an enlarged fragmentary cross-sectional view of the printing head, developing roller and backing electrode in which the toner particles on the developing roller are energized;

FIGS. 6A and 6B are profiles of the voltages applied to the first and second electrodes, respectively, in which a pulse voltage in FIG. 6B is turned off after a pulse voltage in FIG. 6A has been turned off;

FIGS. 8A and 8B are another profiles of the voltages applied to the first and second electrodes, respectively, in which the second pulse is turned on before the first pulse will be turned on;

FIGS. 11A and 11B are another profiles of the voltages applied to the first and second electrodes, respectively, in which the second pulse applied at non-propelling of the toner particles has the same level as that applied at propelling;

DETAILED DESCRIPTION OF THE PREFERRED EMBODIMENTS

Figure 1:
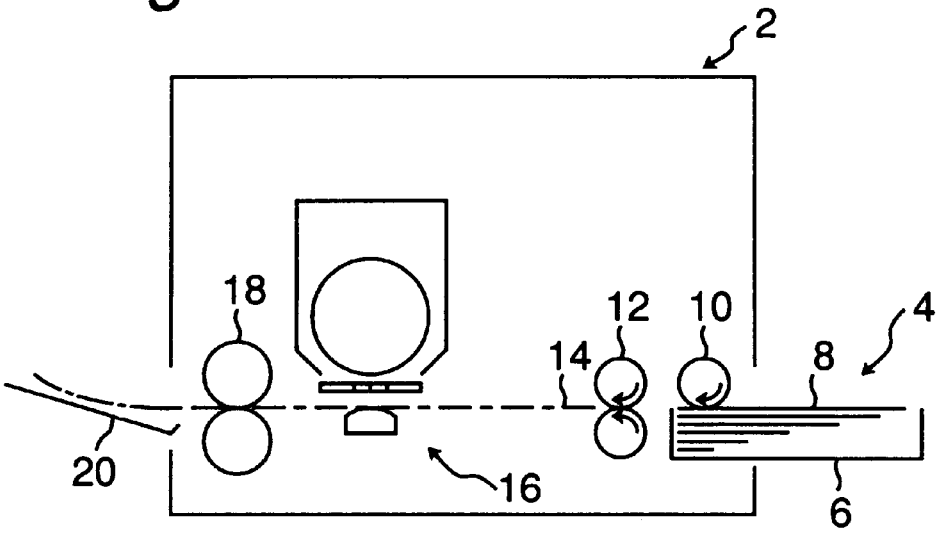
FIG. 1 is a schematic cross-sectional side elevational view of a printing device of the present invention.

With reference to the drawings and in particular to FIG. 1, there is shown a direct printing device generally indicated by reference numeral 2 of the present invention. The printing device 2 has a sheet feed station generally indicated by reference numeral 4. The sheet feed station 4 includes a cassette 6 in which a stack of sheets 8 or plain papers are received. A sheet feed roller 10 is disposed above the cassette 6 so that it can frictionally contact with the top sheet 8 as it rotates for feeding the sheet 8 into the direct printing device 2. Adjacent the sheet feed roller 10, a pair of timing rollers 12 are disposed to forward the sheet 8 fed from the cassette 6 along a sheet passage 14 indicated by a dotted line into a printing station generally indicated by reference numeral 16 where a printing material is deposited thereon to form an image. Further, the printing device 2 includes a fusing station 18 for fusing and permanently fixing the image of printing material onto the sheet 8 and a final stack station 20 for catching the sheets 8 on which the image has been fused.

Figure 2:
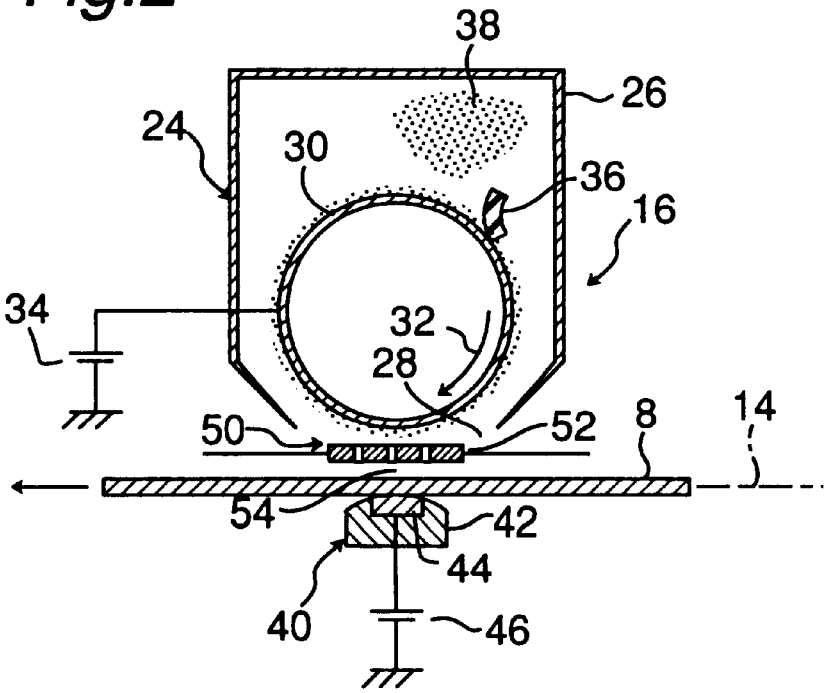
FIG. 2 is a cross-sectional side elevational view of a printing station.

Referring to FIG. 2, the printing station 16 comprises a developing device generally indicated by reference numeral 24 above the sheet passage 14. The developing device 24 comprises a container 26 which has an opening 28 confronting the sheet passage 14. Adjacent the opening 28, a developing roller 30 is supported for rotation in a direction indicated by an arrow 32. The developing roller 30 is made of conductive material and is electrically connected to a DC power source 34. A blade 36, preferably made from a plate of elastic material such as rubber or stainless steel, is disposed in contact with the developer roller 30.

The container 26 accommodates printing particles, i.e., toner particles 38. The toner particles 38 are supplied onto an outer surface of the developer roller 30 and then transported by the rotation of the developer roller 30. The toner particles 38 retained on the developer roller 30 is then transported into a contact region of the developer roller 30 and the blade 36, where they are brought into frictional contact with the blade 36 and thereby charged with a certain polarity. In this embodiment, the toner particles capable of being charged with negative polarity by the contact with the blade 36 are used. Therefore, incremental outer peripheral portions of the developer roller 30 which have moved past the contact region of the developer roller 30 and the blade 36 bear a thin layer of negatively charged toner particles 38. Also, as shown in drawing, the developing roller 30 is supplied with a positive voltage from the power source 34, electrically attracting and retaining the negatively charged toner particles on the developer roller 30.

Disposed under the developing device 24, beyond the sheet passage 14, is an electrode mechanism generally indicated by reference numeral 40 which includes a support 42 made of electrically insulative material and a backing electrode 44 made of electrically conductive material. The backing electrode 44 is electrically connected to a power supply 46 so that it can be provided with a voltage of certain polarity, i.e., positive polarity in this embodiment, electrically attracting the negatively charged toner particles 38 on the developer roller 30 thereto.

Figure 3:
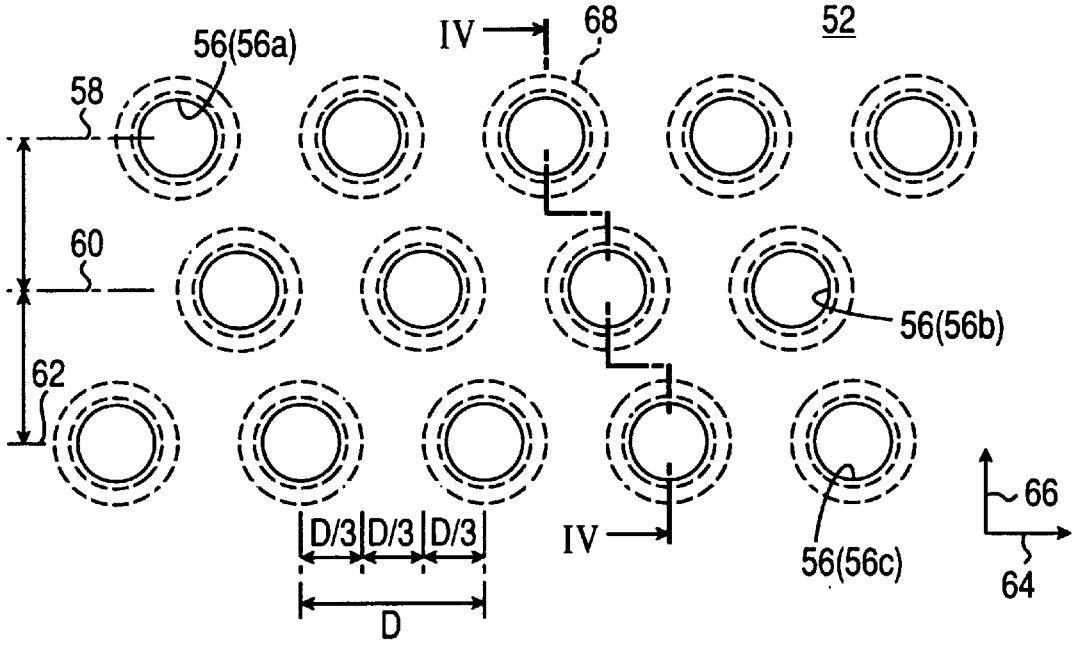
FIG. 3 is an enlarged fragmentary plan view of a print head.

Fixed between the developing device 24 and the electrode mechanism 40 and above the sheet passage 14 is a printing head generally indicated by reference numeral 50. Preferably, the printing head 50 is made from a flexible printed circuit board 52, having a thickness of about 100 to 200 micrometers. As shown in FIGS. 2 and 3, a portion of the printing head 50 located in a printing zone 54 where the developer roller 30 confronts the backing electrode 44 includes a plurality of apertures 56 having a diameter of about 25 to 200 micrometers which is substantially larger than an average diameter (about several micrometers to a dozen micrometers) of the toner particles 38.

In this embodiment, as best shown in FIG. 3, the apertures 56 are formed on equally spaced three parallel lines 58, 60 and 62 each extending in a direction indicated by reference numeral 64 which is parallel to an axis of the developer roller 30 and perpendicular to a direction indicated by reference numeral 66 along which the sheet 8 will be transported, ensuring the printing head 50 with a resolution of 500 dpi. The apertures 56 on the lines 58, 60 and 62 are formed at regular intervals of D, e.g., 127 micrometers, and the apertures 56(56*a*) and 56(56*c*) on the lines 58 and 62 are shifted by the distance DIN to the opposite directions with respect the apertures 56(56*b*) on the central line 60, respectively, so that, when viewed from the sheet transporting direction 66, the apertures 56 appear to be equally spaced. Note that the number N represents the number of line rows and is "3" in this embodiment, however, the number N as well as the interval D can be determined depending upon the required resolution of the print head.

The flexible printed circuit board 52 further includes therein doughnut-like first and second electrodes 68 and 70 each of which surrounding the apertures 56. The first electrode 68 is disposed on one side opposing the developer roller 30 while the second electrode 70 is on the other side opposing the backing electrode 44.

The first electrode 68 is electrically communicated with a driver 72 through a printed wire 74 and the second electrode 70 is electrically communicated with a driver 76 through a printed wire 78, so that the drivers 72 and 76 can transmit image signals to the first and second electrodes 68 and 70, respectively. The drivers 72 and 76 are in turn electrically communicated with a controller 80 that feeds out data of image to be reproduced by the printing device 2.

Referring to FIGS. 6A and 6B, illustrated are image signals 82 and 84 to be transmitted from the drivers 72 and 76 to first and second electrodes 68 and 70 in response to the image data, respectively, for propelling toner particles on the developer roller 30 onto the sheet 8. The image signal 82 for the first electrode 68 consists of a DC component and a pulse component. The DC component is a base voltage V1(B) which is constantly applied to each first electrode 68 from the driver 72. The pulse component, on the other hand, is a pulse voltage V1(P) to be applied in response to the image data from the controller 80 for forming dots on the sheet 8.

Likewise, the image signal 84 for the second electrode 70 consists of a DC component, i.e., base voltage V2(B), which is constantly applied thereto and a pulse component, i.e., pulse voltage V2(P), which is applied in response to the image data from the controller 80.

Specifically, in this embodiment, as shown in FIGS. 6A and 6B, for the first electrode 68, the base voltage V1(B) is about −50 volts, and the pulse voltage V1(P) is about +300 volts. For the second electrode 70, the base voltage V2(B) is about −100 volts and the pulse voltage V2(P) is about +200 volts.

Figure 4:
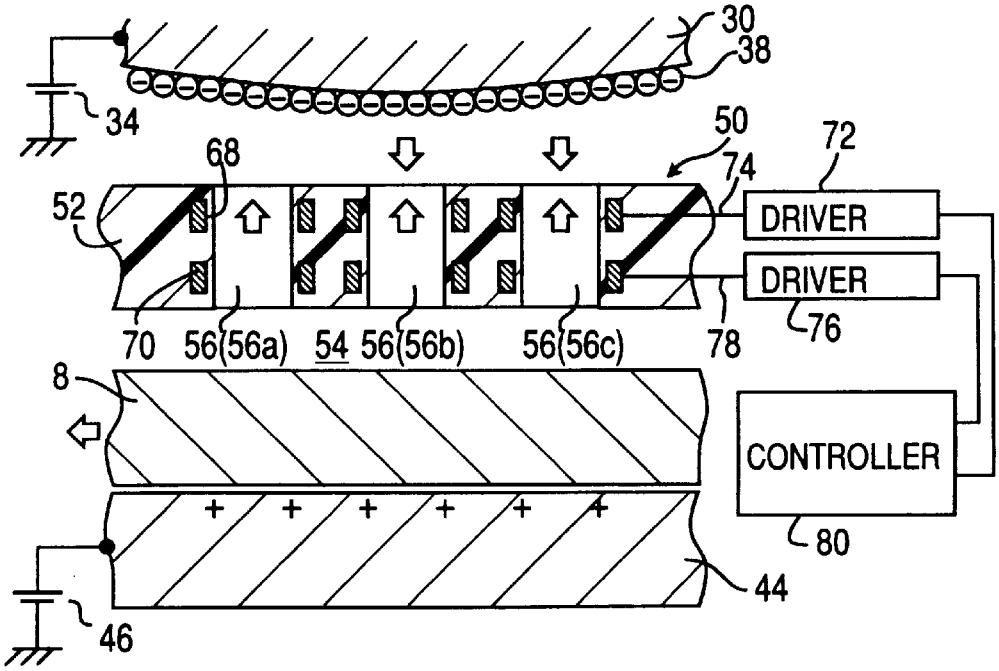
FIG. 4 is an enlarged fragmentary cross-sectional view of the printing head, developing roller and backing electrode taken along a line IV—IV in FIG. 3 in which toner particles on the developing roller are not energized.

With this voltage setting, as shown in FIG. 4, when the base voltages V1(B) (−50 volts) and V2(B) (−100 volts) are applied to the first and second electrodes 68 and 70, respectively, the negatively charged toner particles 38 on the developer roller 30 repels electrically against the first electrode 68, inhibiting the toner particle 38 from propelling toward the aperture 56. Contrary to this, when the pulse voltages V1(P) (+300 volts) and V2(P) (+200 volts) are applied to the first and second electrodes 68 and 70, respectively, the negatively charged toner particles 38 on the corresponding portion of developer roller 30 opposing to the electrodes are electrically attracted and energized by the positively biased first and second electrodes 68 and 70 as well as the backing electrode 44 applied with the positive voltage by the power source 46, causing the toner particles to propel into the aperture 56 toward the backing electrode 44. Subsequently, when the pulse voltages V1(P) and V2(P) are turned off and thereby the voltages applied to the first end second electrodes 68 and 70 are changed to base voltages V1(B) (−50 volts) and V2(B) (−100 volts), respectively, the negatively charged toner particles 38 propelling in the aperture 56 are electrically forced radially inwardly and then converged into a mass by the repelling force from the negatively biased first and second electrodes 68 and 70. Besides, due to the voltage change to the base voltage V1(B) in the first electrode 68, the toner particles 38 on the developer roller 30 are de-energized and therefore further propelling thereof from the developer roller 30 is inhibited.

For the concentration of the toner particles, preferably pulse durations of the pulse voltages V1(P) and V2(P) are so determined that the pulse voltages V1(P) and V2(P) are turned off immediately before the propelling toner particles will reach respective portions adjacent to the first and second electrodes 68 and 70. In this embodiment, a duration of the pulse voltage V1(P) is from 80 to 100 microseconds and a duration of the pulse voltage V2(P) is greater than that of the pulse voltage V1(P) by about 20 to 40 microseconds.

Having described the construction of the printing device 2, its operation will now be described. As shown in FIG. 2, the developer roller 30 rotates in the direction indicated by the arrow 32. The toner particles 38 are deposited on the developer roller 30 and then transported by the rotation of the developer roller 30 into a contact region of the blade 36 and the developer roller 30 where the toner particles 38 are provided with triboelectric negative charge by the frictional contact of the blade 36. Thereby, as shown in FIG. 4, incremental peripheral portions of the developer roller 30 which has passed through the contact region bear a thin layer of charged toner particles 38.

In the printing head 50, the first and second electrodes 68 and 70 are constantly biased to the base voltage V1(B) of about −50 volts and V2(B) of about −100 volts. Therefore, the negatively charge toner particle 38 on the developer roller 30 electrically repels against the first and second electrodes 68 and 70 and therefore stays on the developer roller 30 without propelling toward the aperture 56.

The controller 80 outputs the image data corresponding to an image to be reproduced to the drivers 72 and 76. In response to the image data, the drivers 72 and 76 supplies the respective voltages V1(P) of about +300 volts and V2(P) of about +200 volts to the pairs of first and second electrodes 68 and 70. As a result, the toner particles 38 on the portions of the developer roller 30 confronting the biased electrodes are electrically attracted by the first and second electrodes 68 and 70. This energizes a number of toner particles 38 to propel by the attraction force of the backing electrode 44 into the opposing aperture 56.

When the toner particles 38 have reached respective positions adjacent to the first and second electrodes 68 and 70, the voltages to be applied to the first and second electrodes 68 and 70 are changed from the pulse voltages V1(P) and V2(P) to base voltages V1(B) and V2(B), at respective timings. As a result, the toner particles 38 in the aperture 56 are then forced radially inwardly by the repelling force from the first and second electrodes 68 and 70 applied with the base voltages V1(B) and V2(B), respectively, and then converged into a mass. The converged toner particles 38 are then deposited on the sheet 8 which is moving past the printing zone 54, thereby forming a dot on the sheet 8. Thus, the dot made by the toner particles 38 has a high density and clear contour. Also, by the change of voltage applied to the first electrode from V1(P) to V1(B), the propelling of the toner particles from the developer roller 30 is completed. That is, according to the print head of the invention, the propelling of the toner particles are controlled by the voltage change for the first electrode 68 and the concentration of the toner particles are achieved by the voltage applied to the second electrode 70.

Subsequently, the sheet 8 to which the toner particles 38 are deposited is transported in the fusing station 18 where the toner particles 38 are fused and permanently fixed on the sheet 8 and finally fed out onto the final stack station or catch tray 20.

Figure 7A:
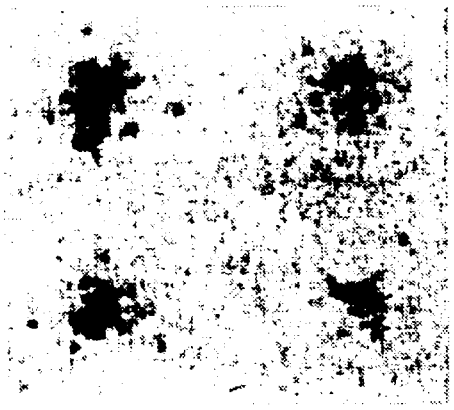
FIGS. 7A and 7B are micrographs showing dots formed by the printing devices of the present invention and the prior art.
Figure 7B:
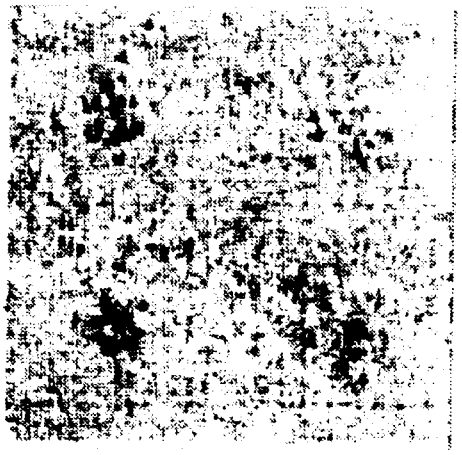

FIG. 7A is a micrograph showing dots formed on the sheet by the deposition of toner particles using the printing device of the invention. FIG. 7B is also a micrograph showing dots formed by the deposition of toner particles using the printing device in which a constant voltage V2(B) having the same polarity as the toner particle is constantly applied to the second electrode at both propelling and non-propelling. The micrographs show that the printing device of the invention ensures a greater number of toner particles to be propelled onto the sheet for each dot and the toner particles are effectively concentrated on the sheet.

Figures 8A, 8B:
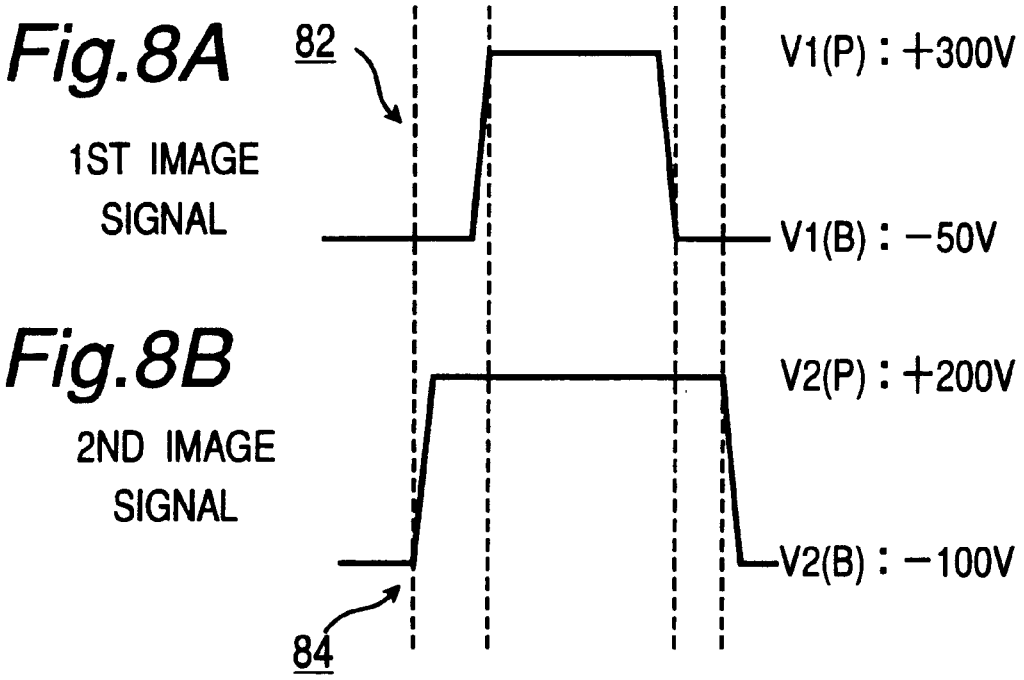

The invention may be changed or modified in various manners. For example, although, in the previous embodiment, the pulse voltages V1(P) and V2(P) are turned on at the same time, the pulse voltage V2 (P) may be turned on before the pulse voltage V1(P) will be turned on as shown in FIGS. 8A and 8B. This increases the number of toner particles to be propelled.

Figures 9A, 9B:
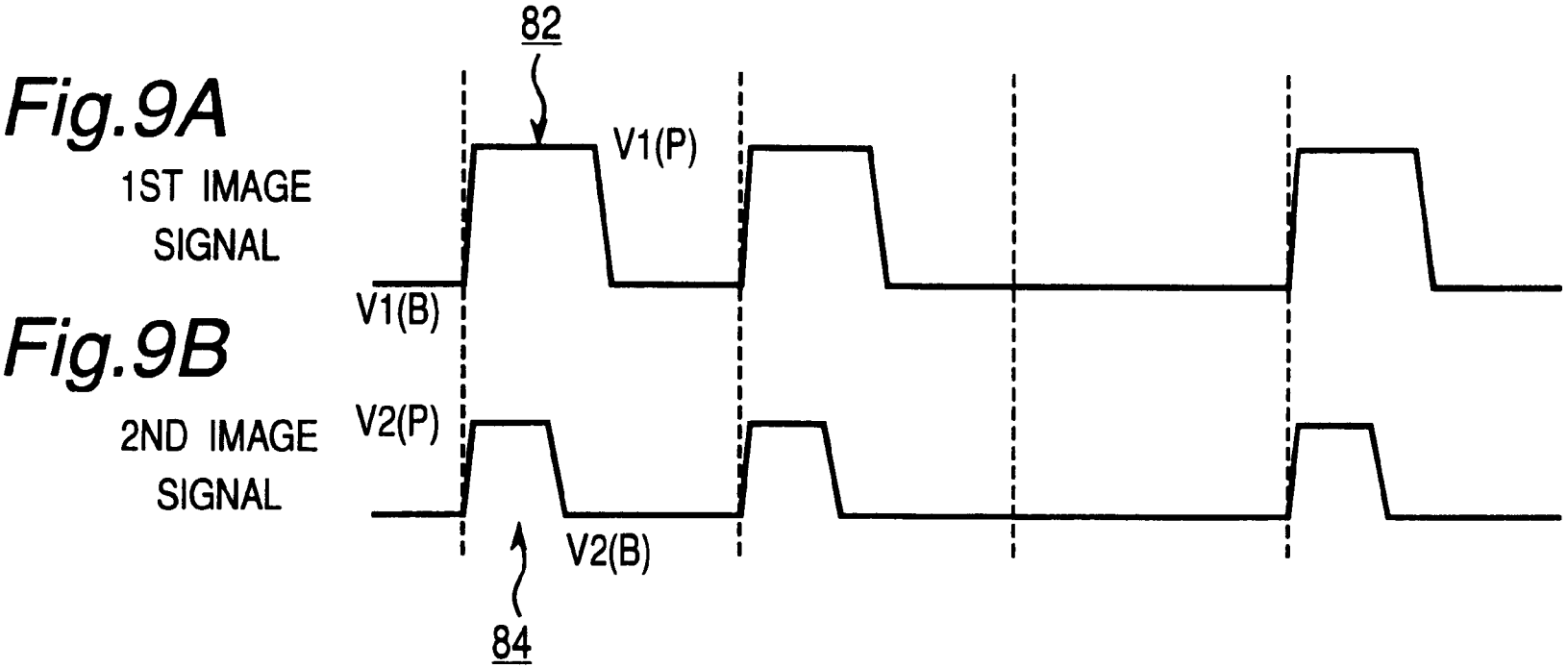
FIGS. 9A and 9B are another profiles of the voltages applied to the first and second electrodes, respectively, in which a duration of the second pulse is longer than that of the first pulse.

Further, as shown in FIGS. 9A and 9B, the duration of the pulse voltage V2(P) may be shorter than that of the pulse voltage V1(P).

Furthermore, it is to be understood that the pulse voltages V1(P) and V2(P) may be turned on and off at the same time.

Although the pulse voltage V2(P) may be transmitted to the second electrode 70 only when the pulse voltage V1(P) is transmitted to the first electrode 68 as shown in FIGS. 9A and 9B, the driver 72 can be designed that the pulse voltage V2(P) is periodically output even when no pulse voltage V1(P) is transmitted to the first electrode 68 as shown in FIGS. 10A, 10B and 11A and 11B.

Figures 10A, 10B:
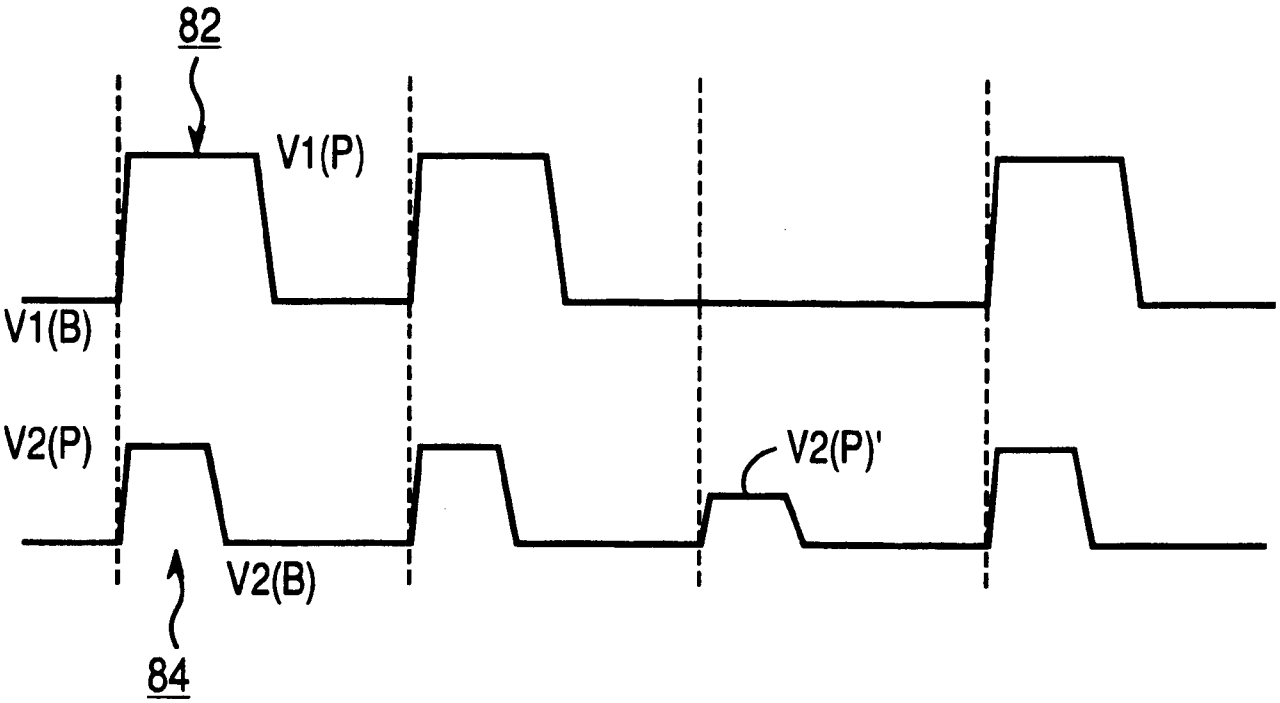
FIGS. 10A and 10B are another profiles of the voltages applied to the first and second electrodes, respectively, in which the second pulse applied at non-propelling of the toner particles is lower than that applied at propelling.

In this case, the pulse voltage V2(P) may be decreased to a lower level of V2 (P)' if no pulse voltage V1(P) is biased to the associated first electrode 68 as shown in FIGS. 10A and 10B.

Figure 12:
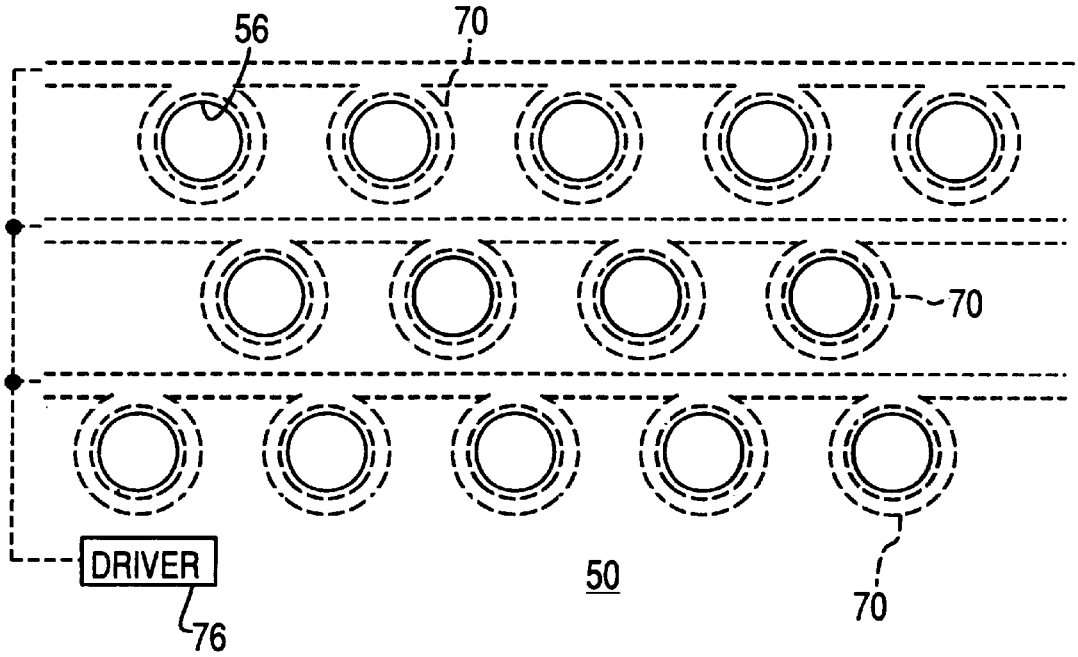
FIG. 12 is an enlarged plan view of the print head in which the plurality of second electrodes are communicated with a driver.

Also, as shown in FIGS. 11A and 11B, the level of the pulse voltage V2(P) may be kept unchanged even when no pulse voltage V1(P) is biased to the associated first electrode 68, allowing the second electrodes 70 to be electrically connected to a single driver circuit in the driver 76 as shown in FIGS. 12A and 12B and thereby to simplify the circuit of the driver 76.

Further, as described in the previous embodiment and modifications, although it is preferably that the base voltage V2(B) has a polarity different from that of toner particles, it is not limited thereto as long as the base voltage can prevent the diverging of the propelling toner particles. For example, according to tests made by the inventors have shown that the negatively charged toner particles were converged even when the base voltage V2(B) was +100 volts.

In addition, it is to be understand that any type of developing device capable of being employed in the electrophotographic image forming apparatus can be used instead of the developing device 24

Further, the backing electrode 44 may be a roller made of electrically conductive material.

In view of the above, it will be seen that the several objects of the invention are achieved and other advantageous results attained.

As various changes could be made in the above construction, it is intended all matter contained in the above description or shown in the accompanying drawings shall be interpreted as illustrative and not in a limiting sense.

What is claimed is:

1. A direct printing apparatus for depositing printing particles on a sheet substrate, comprising:

(a) a bearing member for bearing charged printing particles thereon;

(b) a backing electrode opposed to said bearing member;

(c) a power supply for generating an electric field-that attracts said charged printing particles on said bearing member toward said backing electrode;

(d) a printing head disposed between said bearing member and said backing electrode to form a passage with said backing electrode through which passage said sheet substrate can pass, said printing head including an electrically insulative sheet member having a plurality of apertures through which said printing particles can propel and a plurality pairs of first and second electrodes, each pair of said first and second electrodes surrounding said aperture;

(e) a first driver for applying said first electrodes with a first signal in response to an image signal, said first signal having a voltage that energizes said printing particle on said bearing member to propel the same into said associated aperture toward said backing electrode; and (f) a second driver for applying said second electrode with a second signal, said second signal having a first voltage that energizes said printing particles on said bearing member to propel the same into said associated apertures toward said backing electrode and a second voltage applied to said second electrode subsequent to said first voltage that forces radially inwardly to converge said printing particles propelling in said aperture.

2. A direct printing apparatus claimed in claim 1, wherein said first electrode is arranged on one side adjacent said bearing member and said second electrode is arranged on the other side adjacent said backing electrode.

3. A direct printing apparatus claimed in claim 2, wherein said second electrodes in said printing head are electrically connected with each other.

4. A direct printing apparatus claimed in claim 3, wherein said sheet member is a flexible printed circuit board.

5. A direct printing apparatus claimed in claim 2, wherein said sheet member is a flexible printed circuit board.

6. A direct printing apparatus claimed in claim 1, wherein said second electrodes in said printing head are electrically connected with each other.

7. A direct printing apparatus claimed in claim 6, wherein said sheet member is a flexible printed circuit board.

8. A direct printing apparatus claimed in claim 1, wherein said sheet member is a flexible printed circuit board.

9. A printing head for use in a direct printing apparatus in which said printing head is interposed between a bearing member for bearing charged printing particles thereon and a backing electrode for attracting said printing particles on said developer bearing member toward a sheet substrate which is moving past between said printing head and said backing electrode, comprising:

(a) an insulative sheet member having a plurality of apertures through which said printing particle can pass;

(b) a plurality of first electrodes, each of said first electrodes being disposed adjacent said aperture;

(c) a plurality of second electrodes, each of said second electrodes being disposed adjacent said aperture;

(d) a first driver which applies said first electrodes with a first signal in response to an image signal, said first signal having a voltage that energizes said printing particle on said bearing member to propel the same into said associated aperture toward said backing electrode; and (e) a second driver which applies said second electrode with a second signal, said second signal having a first voltage that energizes said printing particles on said bearing member to propel the same into said associated apertures toward said backing electrode and a second voltage applied to said second electrode subsequent to said first voltage that forces radially inwardly to converge said printing particles propelling in said aperture.

10. A direct printing apparatus claimed in claim 9, wherein said first electrode is arranged on one side adjacent said bearing member and said second electrode is arranged on the other side adjacent said backing electrode.

11. A direct printing apparatus claimed in claim 10, wherein said second electrodes in said printing head are electrically connected with each other.

12. A direct printing apparatus claimed in claim 11, wherein said sheet member is a flexible printed circuit board.

13. A direct printing apparatus claimed in claim 10, wherein said sheet member is a flexible printed circuit board.

14. A direct printing apparatus claimed in claim 9, wherein said second electrodes in said printing head are electrically connected with each other.

15. A direct printing apparatus claimed in claim 14, wherein said sheet member is a flexible printed circuit board.

16. A direct printing apparatus claimed in claim 9, wherein said sheet member is a flexible printed circuit board.

17. A direct printing method for propelling charged printing particles into an aperture formed in an insulative member and then depositing said charged printing particles onto a substrate, comprising the steps of:

(a) applying a first voltage having a polarity opposite to that of said charged printing particles to a first electrode mounted adjacent said aperture for energizing to propel said printing particles;

(b) applying a second voltage having a polarity opposite to that of said charged printing particles to a second electrode mounted adjacent said aperture for further energizing to propel said printing particles in cooperation with said step (a);

(c) applying a third voltage which is different from said first voltage to said first electrode for de-energizing said printing particles on said bearing member; and (d) applying a fourth voltage which is different from said second voltage to said second electrode for forcing radially inwardly to converge said printing particles propelling in said aperture.

18. A direct printing method claimed in claim 17, wherein said first and second electrodes are disposed on upstream and downstream sides, respectively, with respect to a direction along which said printing particles are propelled.

* * * * *

UNITED STATES PATENT AND TRADEMARK OFFICE

CERTIFICATE OF CORRECTION

PATENT NO. : 6,231,164 B1
DATED : May 15, 2001
INVENTOR(S) : Yoshifumi Shibata et al.

It is certified that error appears in the above-identified patent and that said Letters Patent is hereby corrected as shown below:

Title page,
Item [73], Assignee, add -- Array Printers AB, Vastra Frolunda, (Sweden) --

Signed and Sealed this

Fifth Day of March, 2002

*Attest:*

*Attesting Officer*

JAMES E. ROGAN
*Director of the United States Patent and Trademark Office*